US007668323B2

(12) United States Patent
Miyazaki

(10) Patent No.: US 7,668,323 B2
(45) Date of Patent: Feb. 23, 2010

(54) ELECTROSTATIC ULTRASONIC TRANSDUCER AND ULTRASONIC SPEAKER

(75) Inventor: Shinichi Miyazaki, Suwa (JP)

(73) Assignee: Seiko Epson Corporation (JP)

( * ) Notice: Subject to any disclaimer, the term of this patent is extended or adjusted under 35 U.S.C. 154(b) by 500 days.

(21) Appl. No.: 11/232,443

(22) Filed: Sep. 21, 2005

(65) Prior Publication Data

US 2006/0072770 A1 Apr. 6, 2006

(30) Foreign Application Priority Data

Sep. 22, 2004 (JP) ..... 2004-274633

(51) Int. Cl.
*H04R 25/00* (2006.01)

(52) U.S. Cl. ..... 381/190; 381/354

(58) Field of Classification Search ..... 381/116, 381/354, 174, 175, 191, 369, 163; 310/309
See application file for complete search history.

(56) References Cited

U.S. PATENT DOCUMENTS

| | | | | | |
|---|---|---|---|---|---|
| 1,930,518 | A | * | 10/1933 | High | 381/191 |
| 3,084,229 | A | * | 4/1963 | Brettell et al. | 381/372 |
| 3,136,867 | A | * | 6/1964 | Brettell | 381/116 |
| 3,562,429 | A | * | 2/1971 | West | 381/96 |
| 3,646,280 | A | * | 2/1972 | Tamura et al. | 381/191 |
| 3,894,199 | A | * | 7/1975 | Tamura et al. | 381/116 |
| 3,896,274 | A | * | 7/1975 | Fraim et al. | 381/191 |
| 3,941,946 | A | * | 3/1976 | Kawakami et al. | 381/116 |
| 4,311,881 | A | * | 1/1982 | Reynard | 381/163 |
| 4,533,794 | A | * | 8/1985 | Beveridge | 381/174 |
| 5,206,914 | A | * | 4/1993 | Fortney et al. | 381/191 |
| 5,531,128 | A | * | 7/1996 | Ryhanen | 73/862.623 |
| 6,304,662 | B1 | * | 10/2001 | Norris et al. | 381/191 |
| 6,584,205 | B1 | * | 6/2003 | Croft et al. | 381/98 |
| 6,914,991 | B1 | * | 7/2005 | Pompei | 381/111 |
| 2001/0007591 | A1 | * | 7/2001 | Pompei | 381/111 |
| 2004/0047477 | A1 | * | 3/2004 | Bank et al. | 381/120 |

FOREIGN PATENT DOCUMENTS

| | | | |
|---|---|---|---|
| CN | 1290468 | | 4/2001 |
| CN | 1378764 | | 11/2002 |
| JP | 06-209499 | | 7/1994 |
| WO | 99-35884 | | 7/1999 |
| WO | WO 00/18182 | * | 3/2000 |
| WO | 01-15491 | | 3/2001 |

OTHER PUBLICATIONS

Bedout, J.M; "Adaptive-Passive Noise Control With Self-Tuning Helmholtz Resonators"; Apr. 15, 2002; Journal of Sound and Vibration; vol. 202, Issue 1; pp. 109-123.*

* cited by examiner

*Primary Examiner*—Curtis Kuntz
*Assistant Examiner*—Ryan C Robinson
(74) *Attorney, Agent, or Firm*—Harness, Dickey & Pierce, P.L.C.

(57) ABSTRACT

A push-pull type electrostatic ultrasonic transducer includes a vibrating film having a conductive layer and a pair of fixed electrodes provided at respective surfaces of the vibrating film. The front-side fixed electrode and the rear-side fixed electrode sandwich the vibrating film. A plurality of through holes are provided in the front-side fixed electrodes and through holes having the same shape are provided in the rear-side fixed electrode in positions opposed to the respective through holes provided in the front-side fixed electrode. A sound absorbing material is provided facing the rear-side fixed electrode.

9 Claims, 10 Drawing Sheets

ELECTROSTATIC ULTRASONIC TRANSDUCER AND ULTRASONIC SPEAKER

FIELD OF THE INVENTION

The present invention relates to an electrostatic ultrasonic transducer and an ultrasonic speaker using the transducer. Specifically, the present invention relates to an electrostatic ultrasonic transducer arranged to absorb sound waves output to the rear side of a push-pull type ultrasonic transducer and to emit sound waves only from the front side thereof, and an ultrasonic speaker using the transducer.

BACKGROUND OF THE INVENTION

When a modulated wave (sound wave) formed by a amplitude-modulating ultrasonic carrier wave at high sound pressure with an acoustic signal in an audible band is radiated in the air, because of nonlinearity of air, the sound speed becomes high at a location where the sound pressure is high and becomes low at a location where the sound pressure is low. Distortion, therefore, occurs in the waveform as the sound wave propagates in the air. It has been known that, as a result, the distortion is accumulated in the wave form and the carrier component is gradually attenuated as the sound wave propagates in the air, and the acoustic signal component in the audible band used for modulation is self-demodulated. This phenomenon is called a parametric array. Since the self-demodulated audible sound is carried by an ultrasonic wave and has sharp directionality, a speaker applying such a principle is called a parametric speaker, an ultra-directional speaker (ultrasonic speaker), or the like.

As a representative ultrasonic transducer that forms such an ultra-directional speaker (ultrasonic speaker), there are a piezoelectric ultrasonic transducer and an electrostatic ultrasonic transducer. The piezoelectric ultrasonic transducer is a resonant ultrasonic transducer that uses a piezoelectric element such as a piezoelectric material as a vibrator and drives it by utilizing a resonant frequency band thereof. Accordingly, the transducer is characterized in that high sound pressure can be efficiently generated, but the sound pressure-frequency characteristic is in a narrow band.

In contrast, the electrostatic ultrasonic transducer is an ultrasonic transducer that allows an electrostatic force to act between a fixed electrode and a thin electrode film to vibrate the electrode film. It is characterized in that the sound pressure-frequency characteristic is in a wide band.

Since the ultra-directional speaker (ultrasonic speaker) is required to generate high sound pressure, a resonant ultrasonic transducer is generally used in a conventional ultra-directional speaker. However, the conventional ultra-directional speaker is often evaluated as being lower in sound reproduction quality compared to a loudspeaker, and is only used for voice application such as a local announcement or an explanation of an exhibition. Thus, since the resonant ultrasonic transducer has sound pressure-frequency characteristics in a narrow band and limited drive frequencies, there are problems that the sound reproduction quality is difficult to improve and it is difficult to adjustment the reproduction range. Further, since the transducer is sensitive to excessive inputs and its elements are easy to break, there is another problem in that the transducer requires careful handling.

On the other hand, in the case of the electrostatic ultrasonic transducer, since the transducer has an output sound pressure per unit area that is lower than that of the resonant ultrasonic transducer, but sound pressure-frequency characteristics in a wide band, there are advantages that the improvement in reproduction quality is easily realized and the adjustment to the reproduction range is easy. Further, since the vibrator (film) is more flexible compared to that of the resonant ultrasonic transducer, there are advantages that the ultrasonic transducer is difficult to break with excessive inputs and there is no need to be so careful in handling as is the case of the resonant ultrasonic transducer.

Thus, it is more desirable that the ultra-directional speaker is formed using an electrostatic ultrasonic transducer in view of improvement in sound reproduction quality and easy handling.

Further, the electrostatic ultrasonic transducer is mainly divided into two types known as a pull-type and a push-pull type in structure thereof. The respective drawbacks and advantages are as follows.

FIG. 9 is a diagram for explaining the driving concept of a pull-type electrostatic ultrasonic transducer. An alternating current signal is superimposed on a direct current bias output from a DC bias supply and applied between a vibrating film (vibrating electrode film) 21 formed by depositing a conductive layer on a vibrating film (an insulating film or the like) and a fixed electrode 22. The vibrating film 21 is vibrated by the alternating current signal to output ultrasonic wave.

FIG. 9(*a*) shows an amplitude state of the vibrating film 21 in the case where a positive (+) side output of an alternating current signal is superimposed on the direct current bias and applied to the vibrating film 21, and FIG. 9(*b*) shows an amplitude state of the vibrating film 21 in the case where a negative (−) side output of an alternating current signal is superimposed on the direct current bias and applied to the vibrating film 21.

In the case of the state shown in FIG. 9(*a*), as the potential difference between the fixed electrode 22 and the vibrating film 21 becomes larger, a strong electrostatic force (attraction force) acts between the fixed electrode 22 and the vibrating film 21, and the central part of the vibrating film 21 is attracted toward the direction of the fixed electrode 22. In the case of the state shown in FIG. 9(*b*), as the potential difference between the fixed electrode 22 and the vibrating film 21 becomes smaller, an electrostatic force (attraction force) between the fixed electrode 22 and the vibrating film 21 becomes weaker, and the central part of the vibrating film 21 is drawn back toward the opposite direction to the fixed electrode 22 by a resilient restoration force. Thus, the vibrating film 21 vibrates according to the alternating current signal and outputs an ultrasonic wave.

In the pull-type electrostatic ultrasonic transducer, since there is no need to provide a through hole or the like for passing through a sound wave in the fixed electrode like a push-pull type electrostatic ultrasonic transducer (which will be described later), there are advantages that the aperture ratio is large and the sound pressure is easily secured. On the other hand, since the components that contribute to vibration are only the electrostatic attraction force and the resilient restoration force of the film, there is a drawback that the distortion in output waveform becomes larger.

Further, FIG. 10 is a diagram for explaining a driving concept of a push-pull type electrostatic ultrasonic transducer. In the push-pull type electrostatic ultrasonic transducer, a front-side fixed electrode 12 and a rear-side fixed electrode 13 are provided facing a vibrating film (vibrating electrode film) 11. A positive side DC bias is provided to the vibrating film 11 by a DC bias supply and an alternating current signal is applied between the front-side fixed electrode 12 and the rear-side fixed electrode 13.

FIG. 10(*a*) shows an amplitude state of the vibrating film 11 in the case where the alternating current signal is zero (0).

The vibrating film 11 is located in a neutral position (in the middle of the front-side fixed electrode 12 and the rear-side fixed electrode 13). FIG. 10(*b*) shows an amplitude state of the vibrating film 11 in the case where the negative voltage of the alternating current signal is applied to the front-side fixed electrode 12 and the positive voltage of the alternating current signal is applied to the rear-side fixed electrode 13. The central part of the vibrating film 11 is attracted toward the direction of the front-side fixed electrode 12 by an electrostatic force (repulsion force) between the rear-side fixed electrode 13 and itself and an electrostatic force (attraction force) between the front-side fixed electrode 12 and itself.

FIG. 10(*c*) shows an amplitude state of the vibrating film 11 in the case where the positive voltage of the alternating current signal is applied to the front-side fixed electrode 12 and the negative voltage of the alternating current signal is applied to the rear-side fixed electrode 13. The central part of the vibrating film 11 is attracted toward the direction of the rear-side fixed electrode 13 by an electrostatic force (repulsion force) between the front-side fixed electrode 12 and itself and an electrostatic force (attraction force) between the rear-side fixed electrode 13 and itself.

Thus, the vibrating film 11 vibrates according to the alternating current signal and outputs sound waves.

In the push-pull type electrostatic ultrasonic transducer, since both the electrostatic attraction force and the electrostatic repulsion force act on the vibrating film, that is, the electrostatic forces symmetrically act positively and negatively, there is an advantage that the distortion in output waveforms become smaller. On the other hand, since the sound wave is output through the through hole provided in the fixed electrode, there are drawbacks that the aperture ratio is smaller and the sound pressure is difficult to secure.

By the way, in the case of using an electrostatic ultrasonic transducer for the ultra-directional speaker, there is a specific problem that, even when ideal amplitude-modulated waves in an ultrasonic wave band are input to the speaker, if the positively and negatively asymmetric distortion of the waveforms (carrier wave) output from the ultrasonic transducer are large, the distortion component becomes an audible sound component, audible sound is directly output from the speaker other than the ultrasonic wave component, and the directionality of auditory sense becomes low. This is because the electrostatic ultrasonic transducer has a sound pressure characteristic in a wide frequency band (when the audible sound itself is directly input, some degree of sound pressure is provided), and a problem specific to the ultrasonic transducer having wide band characteristics. Accordingly, in order to avoid the above described problems, it is more desirable to use a push-pull type having smaller distortion in output waveform than a pull-type.

In the case where an ultra-directional speaker (ultrasonic speaker) is formed by a push-pull type ultrasonic transducer, since through holes for passing through sound waves are provided in both upper and lower fixed electrodes that sandwich the vibrating film in the conventional ultrasonic transducer, the sound wave is emitted toward both the front surface and the rear surface (e.g., see Patent Document 1).

A case where such an ultra-directional speaker is mounted on equipment such as a projector, for example, and screen sound is realized by reflecting sound waves on a screen for projecting a video will be considered. In this case, when the speaker is provided so as to overhang to the outside of the housing of the projector, there is a problem that realistic sensation is hindered because a person watching the screen from the rear side of the projector directly hears not only the sound reflected by the screen but also the sound from the speaker of the projector main body. On the other hand, there is a problem that realistic sensation is also hindered because the sound wave radiated from the speaker rear surface is reflected on the rear wall and a person watching the screen in front of the projector hears not only the sound reflected by the screen but also the same sound from the rear side.

Further, when the speaker is provided inside the housing of the projector, the above described problem does not occur because the sound wave radiated from the rear surface is blocked by the housing or internal structure and the sound wave is radiated only toward the front side. However, the sound wave reflected at a point-blank range of the housing or internal structure directly bounces back to the vibrating film of the ultrasonic transducer and disturbs the vibration of the vibrating film. As a result, there is a problem that the directionality and sound quality of sound wave output from the front surface becomes deteriorated.

[Patent Document No. JP-A-6-209499]

SUMMARY OF THE INVENTION

In order to achieve the above described purposes, an electrostatic ultrasonic transducer of the invention is a push-pull type electrostatic ultrasonic transducer including a vibrating film having a conductive layer and a pair of fixed electrodes provided at respective surfaces of the vibrating film. A direct current bias voltage is applied to the conductive layer of the vibrating film, and an alternating current signal is applied between the pair of fixed electrodes so as to allow the vibrating film to generate a sound wave. The electrodes output the sound wave generated from the vibrating film from two sound wave output surfaces via through holes provided in the fixed electrodes. A plurality of through holes are provided in the front-side fixed electrode, and through holes having the same shape are provided in the rear-side fixed electrode in positions opposed to the respective through holes provided in the front-side fixed electrode A sound absorbing material is provided at the rear-side fixed electrode.

In the electrostatic ultrasonic transducer of the invention having the above described configuration, the push-pull type electrostatic ultrasonic transducer includes a vibrating film having a conductive layer and a pair of fixed electrodes that are provided to face respective surfaces of the vibrating film. A direct current bias voltage is applied to the conductive layer of the vibrating film, and an alternating current signal is applied between the pair of fixed electrodes so as to allow the vibrating film to generate a sound wave. The electrodes output the sound wave generated from the vibrating film from two sound wave output surfaces via through holes provided in the respective pair of fixed electrodes. The sound wave output from the through holes provided in the rear-side fixed electrode is absorbed by the sound absorbing material provided facing the rear-side fixed electrode.

Thereby, a sound wave with less distortion to the input signal can be radiated only toward the front-side fixed electrode.

Further, an electrostatic ultrasonic transducer of the invention is a push-pull type electrostatic ultrasonic transducer including a vibrating film having a conductive layer and a pair of fixed electrodes provided facing respective surfaces of the vibrating film, wherein a direct current bias voltage is applied to the conductive layer of the vibrating film and an alternating current signal is applied between the pair of fixed electrodes so as to allow the vibrating film to generate a sound wave. The electrodes output the sound wave generated from the vibrating film from two sound wave output surfaces via through holes provided in the respective pair of fixed electrodes. A front-side fixed electrode and a rear-side fixed electrode sandwich the vibrating film. A plurality of through holes are provided in the front-side fixed electrode and through holes having the same shapes as those of the front side electrode are provided in the rear-side fixed electrode in positions opposed to the respective through holes provided in the front-side fixed electrode. A sound insulating cover is provided facing the rear-side fixed electrode at a predetermined distance from a surface thereof.

In the electrostatic ultrasonic transducer of the invention having the above described configuration, the sound insulating cover is provided facing the rear-side fixed electrode at a predetermined distance from a surface thereof. Thereby, a Helmholtz resonator is formed by a gap portion formed between the rear-side fixed electrode and the sound insulating cover and the through portions (through holes) of the rear-side fixed electrode. The gap portion corresponds to a thick closed tube in the Helmholtz resonator and the through portion of the rear-side fixed electrode corresponds to a thin open tube. In the above configuration, according to the principle of the Helmholtz resonator, the air within the through portion of the rear-side fixed electrode as the thin open tube portion becomes a mass point element and the air within the gap portion as the thick closed tube becomes a spring element and a vibration system is formed, and the sound wave output from the through hole provided in the rear-side fixed electrode is absorbed by the friction between the though portion of the rear-side fixed electrode as the thin open tube portion and air. Therefore, a sound wave with less distortion to the input signal can be radiated only toward the front-side fixed electrode.

Further, an electrostatic ultrasonic transducer of the invention is characterized in that distance L between the rear-side fixed electrode and the sound insulating cover is set based on $L=(c/2\pi f)^2 \cdot a/(t+\delta)$ (Where f is an ultrasonic carry wave frequency at the time of rated driving, c is sound speed, a is an aperture ratio of a through portion of the rear-side fixed electrode, t is a thickness of the through portion of the rear-side fixed electrode, and $\delta$ is open-end correction constant depending on the aperture shape of the through portion).

In the electrostatic ultrasonic transducer of the invention having the above describe configuration, the distance L between the rear-side fixed electrode and the sound insulating cover is set based on $L=(c/2\pi f)^2 \cdot a/(t+\delta)$ (Where f is an ultrasonic carry wave frequency at the time of rated driving, c is sound speed, a is an aperture ratio of a through portion of the rear-side fixed electrode, t is a thickness of the through portion of the rear-side fixed electrode, and $\delta$ is open-end correction constant depending on the aperture shape of the through portion). Thereby, the ultrasonic wave emitted to the rear side of the electrostatic ultrasonic transducer can be more efficiently absorbed by a small volume.

Further, an electrostatic ultrasonic transducer of the invention is characterized by including driving means for adjusting a distance between the rear-side fixed electrode and the sound insulating cover and control means for calculating the distance according to a frequency of a carry wave signal applied between the fixed electrode and the vibrating film and controlling the driving means to provide the calculated distance.

In the electrostatic ultrasonic transducer of the invention having the above describe configuration, the distance L is calculated according to a frequency of a carry wave signal applied between the fixed electrode and the vibrating film and the driving means for adjusting a distance between the rear-side fixed electrode and the sound insulating cover is controlled to provide the calculated distance by the control means. Thereby, the ultrasonic wave emitted to the rear side of the electrostatic ultrasonic transducer can be more efficiently absorbed by a small volume.

Further, an electrostatic ultrasonic transducer of the invention is characterized, in the electrostatic ultrasonic transducer, in that a sound absorbing material is provided between the rear-side fixed electrode and the sound insulating cover. In the electrostatic ultrasonic transducer of the invention having the above describe configuration, the ultrasonic wave emitted toward the rear side of the ultrasonic transducer can be more efficiently absorbed by filling the space between the rear-side fixed electrode and the sound insulating cover with the sound absorbing material.

Further, an electrostatic ultrasonic transducer of the invention is a push-pull type electrostatic ultrasonic transducer including a vibrating film having a conductive layer and a pair of fixed electrodes provided facing respective surfaces of the vibrating film. A front-side fixed electrode and a rear-side fixed electrode sandwich the vibrating film. Through holes are provided in the front-side fixed electrode and no through hole is provided in a rear-side fixed electrode.

In the electrostatic ultrasonic transducer of the invention having the above describe configuration, through holes are provided in the front-side fixed electrode for the sound wave to pass through, and the rear-side fixed electrode is formed as a solid electrode with no through hole provided. Thereby, there is no need to align the through holes of the front-side fixed electrode with the through holes of the rear-side fixed electrode as is the case where the through holes are oppositely provided in the pair of fixed electrodes that sandwich the vibrating film, and assembly becomes easier.

Further, an electrostatic ultrasonic transducer of the invention is, in the electrostatic ultrasonic transducer in which through holes are provided in the front-side fixed electrode and the rear-side fixed electrode is formed as a solid electrode with no through hole provided, characterized in that the rear-side fixed electrode is formed by a porous electrode.

In the electrostatic ultrasonic transducer of the invention having the above describe configuration, the rear-side fixed electrode is formed by a porous metal such as Ni. The porous electrode has innumerable air holes on the order from submicrometers to several tens of micrometers and is able to absorb ultrasonic wave.

Thereby, while also allowing an electrostatic force to the rear-side fixed electrode, the sound wave emitted to the rear side of the ultrasonic transducer can be absorbed by the electrode itself.

Thus, since the configuration becomes simple by providing sound absorption property to the electrode itself and there is no need to align the through portions (through holes) of the front-side fixed electrode and the rear-side fixed electrode by forming the rear-side fixed electrode as a solid electrode, assembly becomes easier.

Further, an ultrasonic speaker of the invention includes one of the above described electrostatic ultrasonic transducers and is characterized by being arranged to supply a modulated wave formed by modulating carrier wave in an ultrasonic wave band with an acoustic signal in an audible band.

Since the ultrasonic speaker having the above described configuration has the push-pull type electrostatic ultrasonic transducer in which the sound wave radiated toward the rear side of the ultrasonic transducer is absorbed by sound absorbing means and the sound wave with small distortion to the input signal is radiated only toward the front-side fixed electrode, the distortion of the output waveform can be made smaller and an ultrasonic speaker with high directionality can be formed. Therefore, the ultrasonic speaker is suitable as an ultra-directional speaker intended for being mounted on equipment such as a projector.

Further, an ultrasonic speaker of the invention is characterized by including gain adjustment means for separately adjusting a gain of a power amplifier for amplifying a driving signal to be supplied to the front-side fixed electrode of the electrostatic ultrasonic transducer and a gain of a power amplifier for amplifying a driving signal to be supplied to the rear-side fixed electrode of the electrostatic ultrasonic transducer.

In the ultrasonic speaker having the above described configuration, the gain of a power amplifier for amplifying a driving signal to be supplied to the front-side fixed electrode of the electrostatic ultrasonic transducer and a gain of a power amplifier for amplifying a driving signal to be supplied to the rear-side fixed electrode of the electrostatic ultrasonic transducer are separately adjusted by the gain adjustment means.

By this configuration, electrostatic forces can be allowed to symmetrically act positively and negatively on the vibrating film by the electrostatic forces acting between the front-side fixed electrode and the vibrating film and between the rear-side fixed electrode and the vibrating film, and thereby, the distortion of the output waveform to the input signal can be made smaller.

Further, an ultrasonic speaker of the invention is characterized by being provided with a detection fixed electrode for an amplitude of the vibrating film in part of the front-side fixed electrode and the rear-side fixed electrode of the push-pull type electrostatic ultrasonic transducer. The speaker also includes distortion detection means for detecting vibrating distortion based on information of the amplitude of the vibrating film detected by the detection fixed electrode; first gain adjustment means for adjusting gain of a power amplifier for front-side fixed electrode for amplifying a driving signal to be supplied to the front-side fixed electrode; second gain adjustment means for adjusting gain of a power amplifier for rear-side fixed electrode for amplifying a driving signal to be supplied to the rear-side fixed electrode; and control means for controlling the first and second gain adjustment means based on the vibrating distortion information detected by the distortion detection means so that the vibrating distortion of the push-pull type electrostatic ultrasonic transducer may become smaller.

In the ultrasonic speaker having the above described configuration, a detection fixed electrode for detecting an amplitude of the vibrating film in part of the front-side fixed electrode and the rear-side fixed electrode of the push-pull type electrostatic ultrasonic transducer, and the first and second gain adjustment means are controlled to adjust the gain of the power amplifier for front-side fixed electrode and the power amplifier for rear-side fixed electrode by the control means so that the vibrating distortion of the push-pull type electrostatic ultrasonic transducer may become smaller (the vibrating film may vibrate faithfully to the input signals).

Thereby, even in the case where mechanical characteristics and electrical characteristics vary because of aging or the like, the gain of the power amplifier for front-side fixed electrode and the power amplifier for rear-side fixed electrode is automatically adjusted and the ultrasonic wave with low distortion can be output constantly. That is, the directionality of reproduced sound (self-demodulated sound) can be constantly maintained high.

DETAILED DESCRIPTION OF THE PREFERRED EMBODIMENTS

Figure 1:
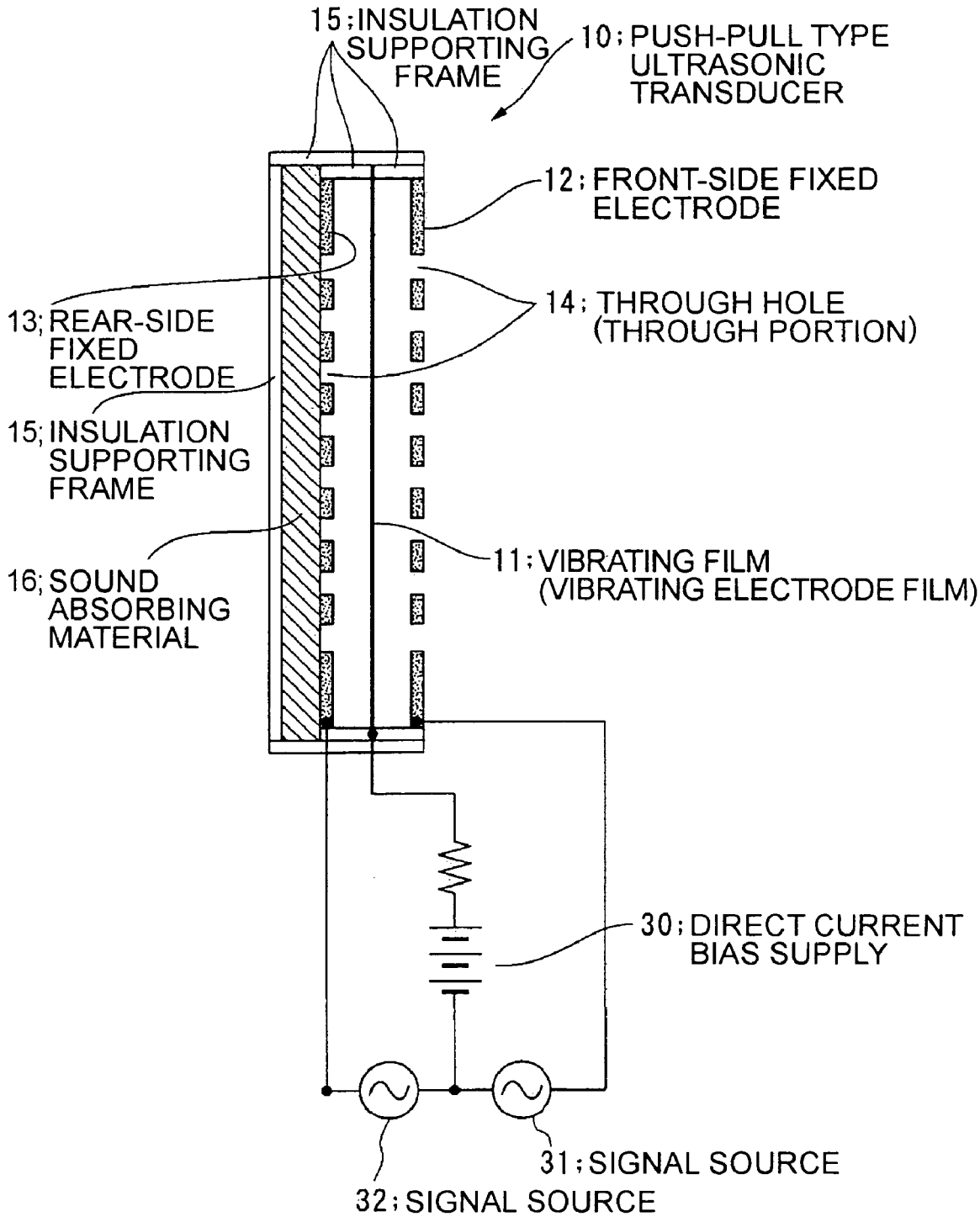
FIG. 1 is a side sectional view showing a configuration of an electrostatic ultrasonic transducer according to the first embodiment of the invention.

Hereinafter, embodiments of the invention will be described in detail by referring to the drawings.

A configuration (side sectional view) of an electrostatic ultrasonic transducer according to the first embodiment of the present invention is shown in FIG. 1. The electrostatic ultrasonic transducer according to the first embodiment of the present invention is an example in which a sound absorbing material for absorbing an ultrasonic wave is provided facing a rear-side fixed electrode and a sound wave emitted from the rear side of a push-pull type electrostatic ultrasonic transducer is absorbed by the sound absorbing material.

In FIG. 1, the electrostatic ultrasonic transducer according to the first embodiment of the invention has a vibrating film (vibrating electrode film) 11 having a conductive layer and a pair of fixed electrodes, a front-side fixed electrode 12 and a rear-side fixed electrode 13, provided facing the respective surfaces of the vibrating film 11. The vibrating film 11 may be formed by sandwiching the conductive layer (conducting film) that forms an electrode between insulating films, or the entire vibrating film 11 may be formed by a conductive material.

Further, the front-side fixed electrode 12 and the rear-side fixed electrode 13 sandwich the vibrating film 11. A plurality of through holes 14 are provided in the front-side fixed electrode 12, and a plurality of through holes 14 having the same shapes are provided in the rear-side fixed electrode 13 in positions that face the respective through holes 14 provided in the front-side fixed electrode 12. The front-side fixed electrode 12, the rear-side fixed electrode 13, and the vibrating film 11 are supported in a condition in which they are electrically insulated by an insulation support frame 15. Furthermore, a sound absorbing material 16 is provided facing the rear-side fixed electrode 13 in a gap portion formed between the insulation support frame 15 located at the rear side of the rear-side fixed electrode 13 and the rear-side fixed electrode 13. For example, glass wool or a porous material may be used for the sound absorbing material 16.

A direct current bias voltage is applied to the conductive layer of the vibrating film 11 by a direct current bias supply 30. An alternating current signal output from a signal source 31 is superimposed on the direct current bias voltage and applied between the front-side fixed electrode 12 and the vibrating film 11. An alternating current signal output from a signal source 32 is superimposed on the direct current bias voltage and applied between the rear-side fixed electrode 13 and the vibrating film 11. There is a phase difference of 180° between the alternating current signal output from the signal source 31 and the alternating current signal output from the signal source 32. Although two signal sources are shown in FIG. 1, an alternating current signal output from one signal source may be applied to one fixed electrode and an alternating current signal formed by phase-inverting the alternating current signal may be applied to the other fixed electrode.

In the above configuration, a direct current bias is applied to the vibrating film 11 by the direct current bias supply 30 and driving signals (alternating current signals) phase-inverted from each other are applied by the signal sources 31 and 32 to the front-side fixed electrode 12 and the rear-side fixed electrode 13. Thereby, an electrostatic attraction force and an electrostatic repulsion force simultaneously act on the vibrating film 11 in the same direction, and the vibrating film 11 is push-pull driven at each time when the polarity of the driving signals (alternating current signals) output from the signal sources 31 and 32 is reversed because the directions in which the electrostatic attraction force and the electrostatic repulsion force act change.

As a result, the sound wave generated by the vibrating film is emitted to the outside through the through holes (through portions) 14 provided in the front-side fixed electrode 12 and the rear-side fixed electrode 13. In this regard, since the through holes (through portions) 14 having the same shapes are respectively provided in opposed positions via the vibrating film 11 in the front-side fixed electrode 12 and the rear-side fixed electrode 13, the electrostatic forces acting on the vibrating film 11 are negatively and positively symmetric (relative to the sine wave input), and a sound wave with small distortion compared to the input signal is generated and emitted to the outside through the through holes (through portions) 14.

Outside of the rear-side fixed electrode 13, the ultrasonic wave emitted to the rear side is absorbed by the sound absorbing material 16 provided facing the rear-side fixed electrode. Accordingly, the ultrasonic wave with small distortion can be radiated only to the front side of the push-pull type electrostatic ultrasonic transducer 10. In FIG. 1, as the configuration of the push-pull type electrostatic ultrasonic transducer 10, the example formed with a gap between the front-side fixed electrode 12 and the vibrating film and the rear-side fixed electrode 13 and the vibrating film over the entire vibrating film 11 (for loudspeaker) has been shown, however, the transducer may be formed so that parts of the vibrating film and fixed electrodes may be brought into contact (for ultrasonic speaker).

Figure 2:
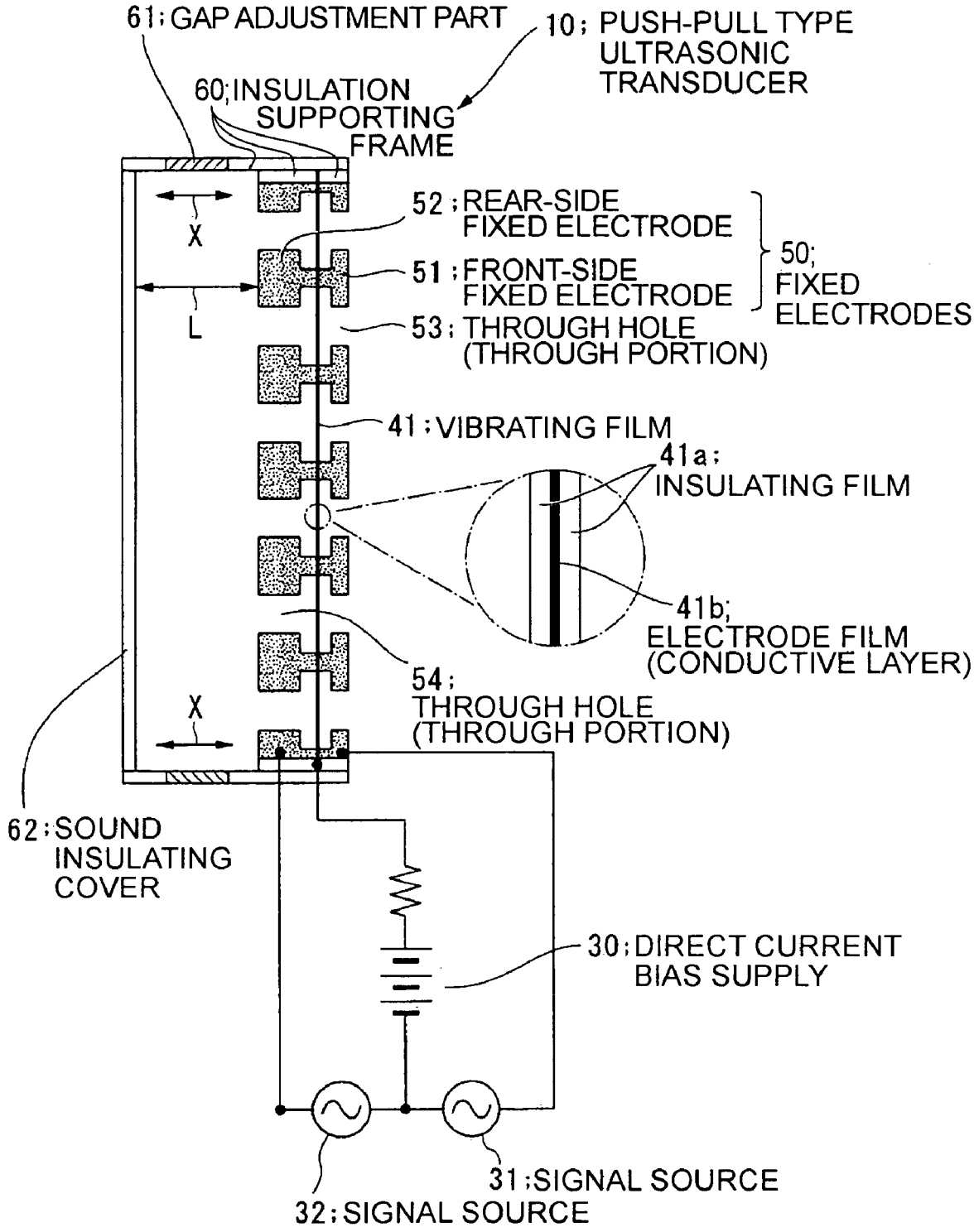
FIG. 2 is a side sectional view showing a configuration of an electrostatic ultrasonic transducer according to the second embodiment of the invention.

Next, a configuration (side sectional view) of an electrostatic ultrasonic transducer according to the second embodiment of the invention is shown in FIG. 2. The electrostatic ultrasonic transducer according to the first embodiment of the invention is shown as an example in which sound is absorbed utilizing the friction of air in space formed by a gap portion formed between the rear-side fixed electrode and a sound insulating cover and through portions of the rear-side fixed electrode. In FIG. 2, an example in which parts of fixed electrodes sandwich a vibrating film in contact for improving the sensitivity in the ultrasonic wave band is shown.

In FIG. 2, the electrostatic ultrasonic transducer according to the second embodiment of the invention has a vibrating film 41 having a conductive layer and a pair of fixed electrodes 50 including a front-side fixed electrode 51 and a rear-side fixed electrode 52 provided facing the respective surfaces of the vibrating film 41.

The vibrating film 41 is formed by sandwiching the conductive layer (conducting film) 41*b* that forms an electrode between insulating films 41*a*. Further, only the parts of the front-side fixed electrode 51 and the rear-side fixed electrode 52 in contact with the vibrating film 41 may be formed by insulating members, and the entire vibrating film 41 may be formed by a conductive material.

Further, the front-side fixed electrode 51 and the rear-side fixed electrode 52 sandwich the vibrating film 41. A plurality of through holes (through portions) 53 are provided in the front-side fixed electrode 51. A plurality of through holes (through portions) 54 having the same shapes are provided in the rear-side fixed electrode 52 in positions opposed to the respective through holes 53 provided in the front-side fixed electrode 51. The front-side fixed electrode 51, the rear-side fixed electrode 52, and the vibrating film 41 are supported in a condition in which they are electrically insulated by an insulation support frame 60.

A direct current bias voltage is applied to the conductive layer of the vibrating film 41 by a direct current bias supply 30. An alternating current signal output from a signal source 31 is superimposed on the direct current bias voltage and applied between the front-side fixed electrode 51 and the vibrating film 41, and an alternating current signal output from a signal source 32 is superimposed on the direct current bias voltage and applied between the rear-side fixed electrode 52 and the vibrating film 41. There is a phase difference of 180° between the alternating current signal output from the signal source 31 and the alternating current signal output from the signal source 32. Although two signal sources are shown in FIG. 2, as well as in the first embodiment, an alternating current signal output from one signal source may be applied to one fixed electrode and an alternating current signal formed by phase-inverting the alternating current signal may be applied to the other fixed electrode.

Further, in the electrostatic ultrasonic transducer according to the embodiment, a sound insulating cover 62 is provided facing the surface of the rear-side fixed electrode 52 at a predetermined distance L. This predetermined distance L can be adjusted in the direction of arrow X by a gap adjustment part 61.

The gap adjustment part 61 is formed by a linear actuator such as a linear motor and mechanism parts, for example.

A Helmholtz resonator is formed by a gap portion formed between the rear-side fixed electrode 52 and the sound insulating cover 62 and the through holes (through portions) 54 of the rear-side fixed electrode 52 shown in FIG. 2. That is, the continuous space formed by the gap portion formed between the rear-side fixed electrode 52 and the sound insulating cover 62 and the through holes (through portions) 54 of the rear-side fixed electrode 52 correspond to a Helmholtz resonator, and sound absorption action occurs based on the same principle as that of the sound absorption by a Helmholtz resonator.

A Helmholtz resonator is an acoustic tube formed by connecting a closed tube having a volume V to one end of a thin open tube having a cross-sectional area S and a length t. The through portion 54 of the rear-side fixed electrode 52 corresponds to a thin open tube in the Helmholtz resonator, and the gap portion formed between the rear-side fixed electrode 52 and the sound insulating cover 62 corresponds to a thick closed tube in the Helmholtz resonator. The air in the above described thin open tube portion becomes a mass point element and the air in the thick closed tube becomes a spring element and a vibration system is formed. Sound absorption is mainly performed by the friction between the thin open tube and air.

The resonant frequency f of such a Helmholtz resonator is given by the formula:

$$f=(c/2\pi)\cdot\sqrt{(S/Vt)} \quad (1)$$

where the sound speed is c.

Practically, the real resonant frequency is obtained not using the length t of the thin open tube without change, but by using a length t' that has been subjected to open-end correction.

For example, in the case of a circular tube having diameter d, the open-end correction given by $$t'=t+0.8d \quad (2).$$

Assuming that the aperture ratio of the through portion 54 of the rear-side fixed electrode 52 is a, and the distance from the rear-side fixed electrode 52 to the sound insulating cover 62 is L, the equation (1) is rewritten as $$f=(c/2\pi)\cdot\sqrt{(a/Lt)} \quad (3)$$

where t is obtained by performing open-end correction on the thickness (length) of the through portion 54 of the rear-side fixed electrode 52.

In the case where the electrostatic ultrasonic transducer is applied to an ultrasonic speaker, the ultrasonic carrier wave radiated to the rear side can be efficiently absorbed when the aperture ratio and thickness of the rear-side fixed electrode through portion and the distance from the rear-side fixed electrode to the sound insulating cover are set so that the resonant frequency (equation (3)) of the sound absorption system formed at the rear side of the ultrasonic transducer may agree with the carry wave frequency at the time of rated driving of the ultrasonic speaker.

That is, in the case of an ultrasonic speaker with a carry wave frequency f at the time of rated driving, assuming that the aperture ratio of the rear-side fixed electrode 52 is a and the thickness is t, when the sound insulating cover 62 is provided so that distance L from the rear-side fixed electrode 52 to the sound insulating cover 62 may be $$L=(c/2\pi f)^2\cdot a/(t+\delta) \quad (4)$$

the ultrasonic wave emitted to the rear side can be more efficiently absorbed by a small volume, where c is sound speed and δ is an open-end correction constant depending on the aperture shape of the through portion.

Figure 3:
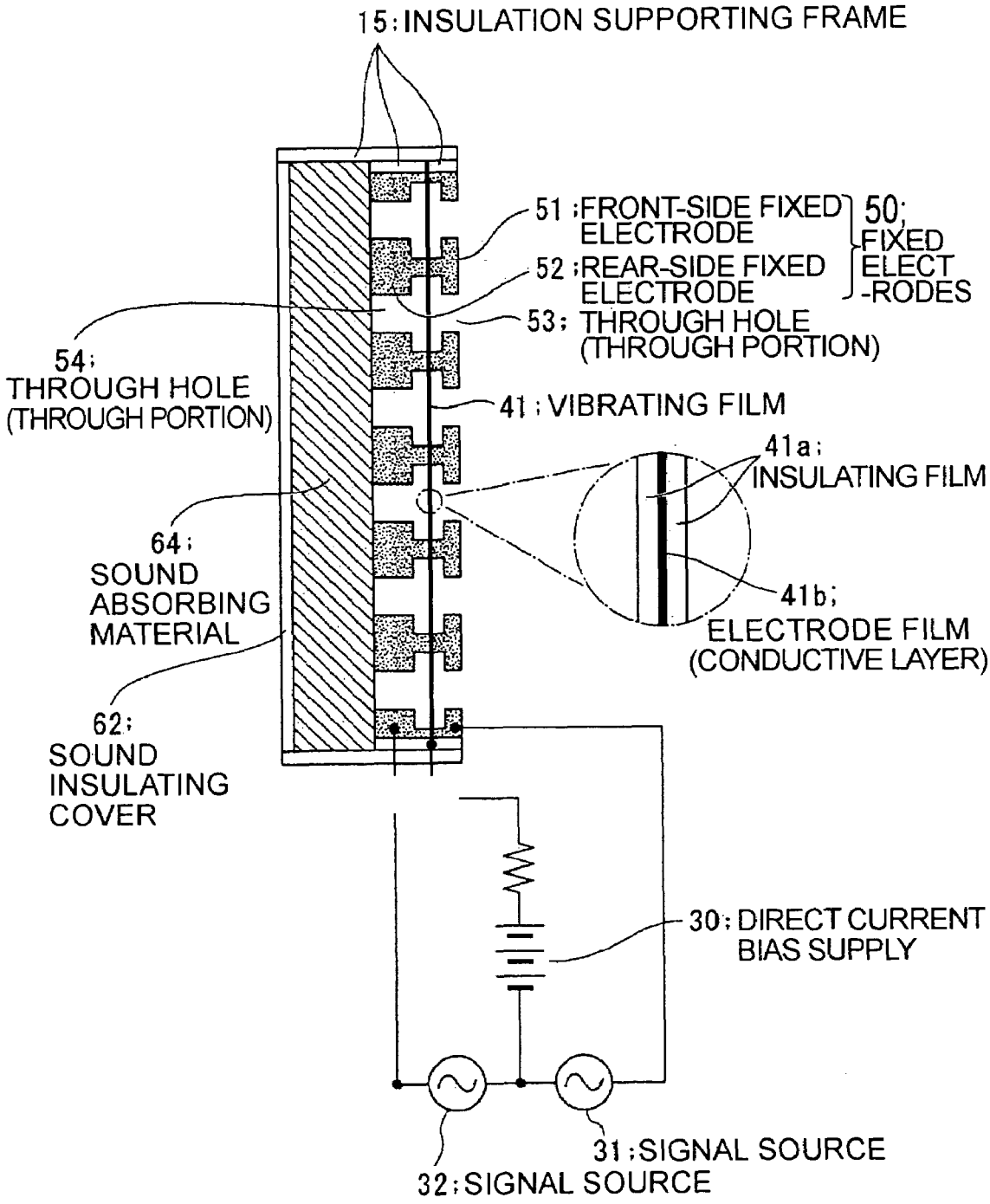
FIG. 3 is a side sectional view showing a configuration of a modified example of the electrostatic ultrasonic transducer according to the second embodiment of the invention.

In the configuration shown in FIG. 2, as shown in FIG. 3, sound can be more efficiently absorbed by filling the space between the rear-side fixed electrode 52 and the sound insulating cover 62 with a sound absorbing material 64. In the electrostatic ultrasonic transducer shown in FIG. 3, the gap adjustment part for adjusting the distance L between the sound insulating cover 62 and the rear-side fixed electrode 52 is not provided, however, in the embodiment, as described above, in the case of an ultrasonic speaker with carry wave frequency of f at the time of rated driving, assuming that the aperture ratio of the rear-side fixed electrode 52 is a and the thickness is t, the sound insulating cover 62 is formed so that the distance L between the sound insulating cover 62 and the rear-side fixed electrode 52 may be as expressed by the above equation (4).

In the above configuration, a direct current bias is applied to the vibrating film 41 by the direct current bias supply 30 and driving signals (alternating current signals) phase-inverted from each other are applied by the signal sources 31 and 32 to the front-side fixed electrode 51 and the rear-side fixed electrode 52. Thereby, an electrostatic attraction force and an electrostatic repulsion force simultaneously act on the vibrating film 41 in the same direction, and the vibrating film 41 is push-pull driven at each time when the polarity of the driving signals (alternating current signals) output from the signal sources 31 and 32 is reversed because the directions in which the electrostatic attraction force and the electrostatic repulsion force act change. The sound waves generated by the vibrating film are output from two sound wave output surfaces through the through holes 53 and 54 provided respectively in the pair of fixed electrodes.

On the other hand, according to a principle of the Helmholtz resonator, the air within the though portion 54 of the rear-side fixed electrode 52 as a thin open tube portion becomes a mass point element and the air within the gap portion formed between the rear-side fixed electrode 52 and the sound insulating cover 62 as a thick closed tube becomes a spring element. A vibration system is thereby formed, and the sound wave output from the through hole 54 provided in the rear-side fixed electrode 52 is absorbed by the friction between the though portion 54 of the rear-side fixed electrode 52 as the thin open tube portion and air.

Therefore, the sound wave with less distortion to the input signal can be radiated only toward the front-side fixed electrode 51.

Figure 5:
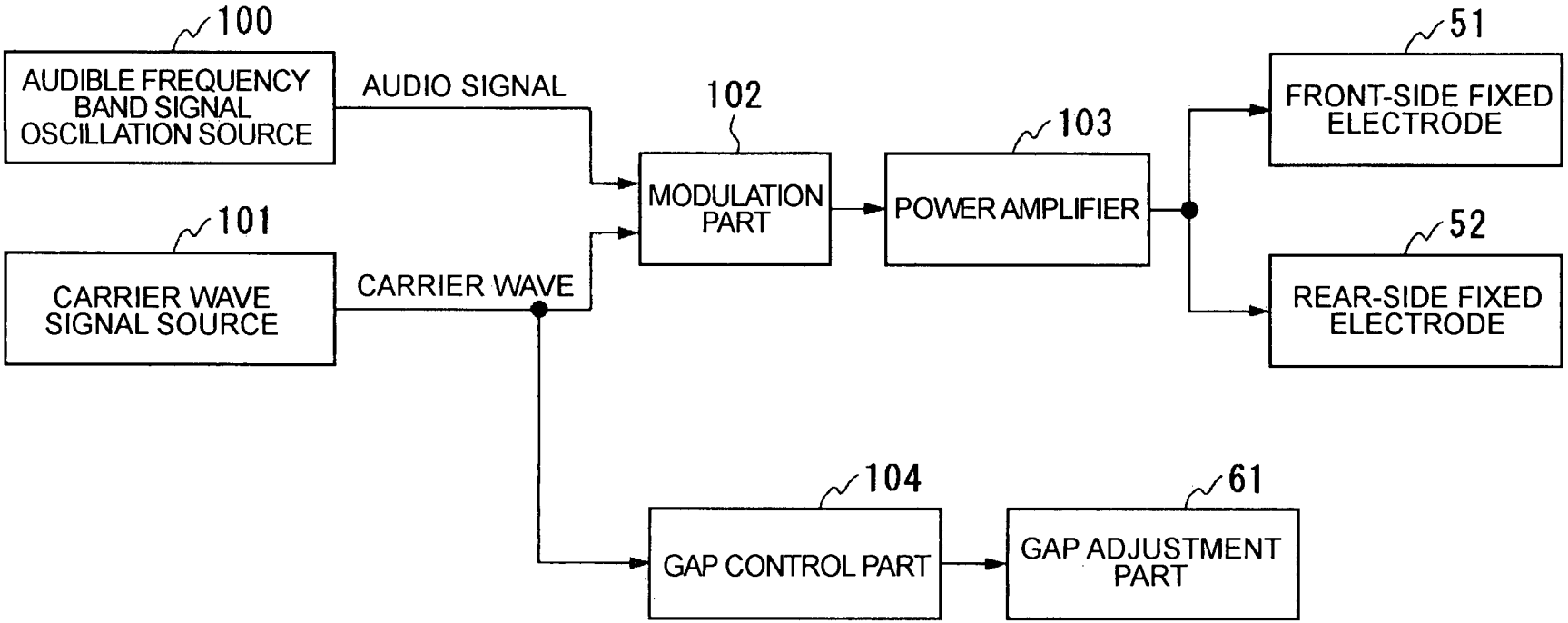
FIG. 5 is a block diagram showing an electric configuration of an ultrasonic speaker according to the first or second embodiment of the invention.

Next, an electrical configuration of an ultrasonic speaker having an electrostatic ultrasonic transducer shown in FIG. 1 or 2 according to the first or second embodiment is shown in FIG. 5. When a signal formed by modulating carrier wave in an ultrasonic wave band with signal wave in an audible band (e.g., audio signal) is output from the ultrasonic transducer as described above, the directionality of the audio signal self-demodulated by the parametric array effect becomes very high. Thus, the speaker arranged to output the modulated waveform of ultrasonic wave and reproduce sound with high directionality is called an ultrasonic speaker. In FIG. 5, the ultrasonic speaker according to the first or second embodiment has an audible frequency band signal oscillation source 100 for generating signal wave in an audible frequency band (e.g., audio signal), a carrier wave signal source 101 for generating a carrier wave in an ultrasonic wave frequency band, a modulation part 102, a power amplifier 103 for power amplifying the output (driving signal) of the modulation part 102 and output the signal to the front-side fixed electrode 51 and the rear-side fixed electrode 52, a gap control part 104, and a gap adjustment part 61.

The modulation part 102 modulates the carrier wave output from the carrier wave signal source 101 with a signal wave in an audible frequency band being output from the audible frequency band signal oscillation source 100. The gap adjustment part 61 adjusts the distance between the rear-side fixed electrode 52 and the sound insulating cover 62 in FIG. 2.

The gap control part 104 calculates the distance L between the rear-side fixed electrode 52 and the sound insulating cover 62 from the equation (4) according to the frequency of the carrier wave signal applied between the rear-side fixed electrode 52 and the vibrating film 41 and controlling the gap adjustment part 61 to provide the calculated distance L.

The gap adjustment part 61 corresponds to driving means of the invention and the gap control part 104 corresponds to control means of the invention, respectively.

In the configuration, the signal wave in the audible frequency band is generated by the audible frequency band signal oscillation source 100 and input to the modulation part 102.

Further, the carrier wave in the ultrasonic wave band is generated by the carrier wave signal source 101 and input to the modulation part 102. In the modulation part 102, the carrier wave in the ultrasonic wave frequency band is modulated by the signal wave in the audible frequency band and the modulated signal is power-amplified by the power amplifier 103 to a predetermined level.

The output signals (driving signals) of the power amplifier 103 are output to the front-side fixed electrode 51 and the rear-side fixed electrode 52, the vibrating film 41 shown in FIG. 2 is push-pull driven, and the waves generated by the vibrating film are output from two sound wave output surfaces through the through holes 53 and 54 provided respectively in the pair of fixed electrodes.

Here, though omitted in FIG. 5, the driving signals output from the power amplifier 103 are phase-adjusted by phase adjustment means between the driving signal supplied to the front-side fixed electrode 51 and the driving signal supplied to the rear-side fixed electrode 52 so that the phases are inversed from each other.

On the other hand, the carrier wave in the ultrasonic wave band output from the carrier wave signal source 101 is input to the gap control part 104. The gap control part 104 calculates distance L between the rear-side fixed electrode 52 and the sound insulating cover 62 from the equation (4) according to the frequency of the carrier wave signal (carrier wave) applied between the rear-side fixed electrode 52 and the vibrating film 41, and controls the gap adjustment part 61 to provide the calculated distance L.

That is, the distance from the rear-side fixed electrode to the sound insulating cover is set based on the equation (4) so that the resonant frequency (equation (3)) of the sound absorption system formed at the rear side of the ultrasonic transducer may agree with the carry wave frequency at the time of rated driving of the ultrasonic speaker.

As a result, as described above, according to a principle of a Helmholtz resonator, the air within the though portion 54 of the rear-side fixed electrode 52 as a thin open tube portion becomes a mass point element and the air within the gap portion formed between the rear-side fixed electrode 52 and the sound insulating cover 62 as a thick closed tube becomes a spring element. A vibration system is thereby formed, and the sound wave output from the through hole 54 provided in the rear-side fixed electrode 52 is absorbed by the friction between the though portion 54 of the rear-side fixed electrode 52 as the thin open tube portion and air.

Therefore, a sound wave with less distortion to the input signal can be radiated only toward the front-side fixed electrode 51.

Figure 4:
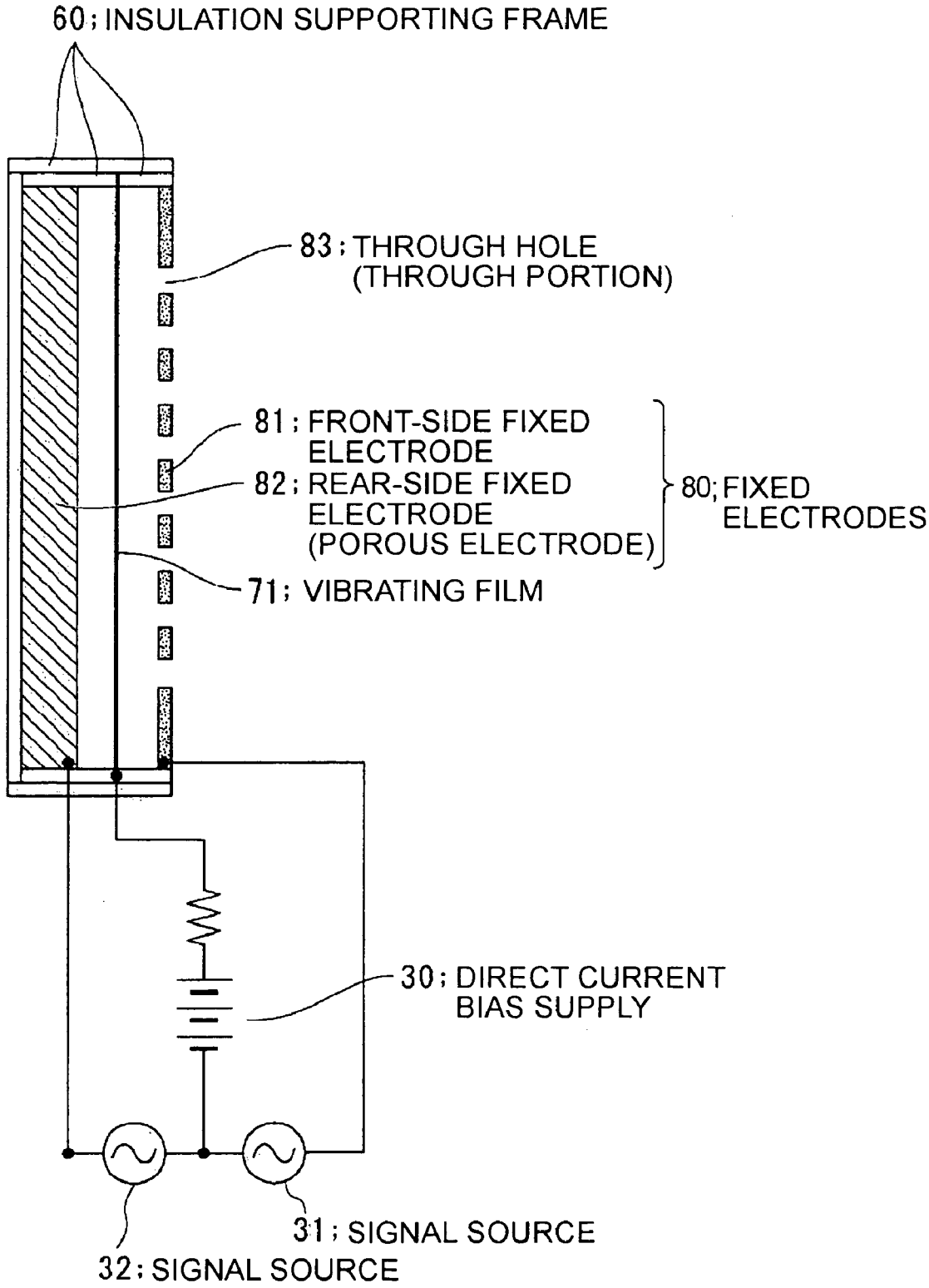
FIG. 4 is a side sectional view showing a configuration of an electrostatic ultrasonic transducer according to the third embodiment of the invention.

Next, a configuration of an electrostatic ultrasonic transducer according to the third embodiment of the invention is shown in FIG. 4. The configuration of an electrostatic ultrasonic transducer according to the third embodiment of the invention shows a configuration example in which through portions are provided in a fixed electrode at the front side and a fixed electrode at the rear side is formed as a solid electrode provided with no through portion.

In FIG. 4, the configuration of the electrostatic ultrasonic transducer according to the third embodiment of the invention has a vibrating film (vibrating electrode film) 71 having a conductive layer and a pair of fixed electrodes of a front-side fixed electrode 81 and a rear-side fixed electrode 82 provided facing the respective surfaces of the vibrating film 71. The vibrating film 71 may be formed by sandwiching the conductive layer (conducting film) that forms an electrode between insulating films or the entire vibrating film 71 may be formed by a conductive material.

Further, the front-side fixed electrode 81 and the rear-side fixed electrode 82 sandwich the vibrating film 71. A plurality of through holes 83 are provided in the front-side fixed electrode 81 and the rear-side fixed electrode 82 is formed as a solid electrode provided with no through hole. For the rear-side fixed electrode 82, a porous metal such as Ni is used. The porous electrode has innumerable air holes on the order from sub-micrometers to several tens of micrometers and is able to absorb an ultrasonic wave.

The front-side fixed electrode 81, the rear-side fixed electrode 82, and the vibrating film 71 are supported in a condition in which they are electrically insulated by an insulation support frame 60.

A direct current bias voltage is applied to the conductive layer of the vibrating film 71 by a direct current bias supply 30, and an alternating current signal output from a signal source 31 is superimposed on the direct current bias voltage and applied between the front-side fixed electrode 81 and the vibrating film 71 and an alternating current signal output from a signal source 32 is superimposed on the direct current bias voltage and applied between the rear-side fixed electrode 82 and the vibrating film 71. There is a phase difference of 180° between the alternating current signal output from the signal source 31 and the alternating current signal output from the signal source 32. Although two signal sources are shown in FIG. 4, as well as in the other embodiments, an alternating current signal output from one signal source may be applied to one fixed electrode and an alternating current signal formed by phase-inverting the alternating current signal may be applied to the other fixed electrode.

In the above configuration, a direct current bias is applied to the vibrating film 71 by the direct current bias supply 30 and driving signals (alternating current signals) phase-inverted from each other are applied by the signal sources 31 and 32 to the front-side fixed electrode 81 and the rear-side fixed electrode 82, and thereby, an electrostatic attraction force and an electrostatic repulsion force simultaneously act on the vibrating film 71 in the same direction. The vibrating film 71 is also push-pull driven at each time when the polarity of the driving signals (alternating current signals) output from the signal sources 31 and 32 is reversed because the directions in which the electrostatic attraction force and the electrostatic repulsion force act change. The sound wave generated by the vibrating film 71 is output from the sound wave output surface through the through holes 83 provided in the front-side fixed electrode 81.

Simultaneously, the sound wave generated by the vibrating film 71 is nearly output from the sound wave output surface rearward than the rear-side fixed electrode 82.

However, since a porous electrode is used as the rear-side fixed electrode 82, the ultrasonic wave output from the rear-side fixed electrode 82 is absorbed by the innumerable air holes existing in the porous electrode. Thereby, while also allowing an electrostatic force to the rear-side fixed electrode 82, the sound wave emitted to the rear-side fixed electrode 82 can be absorbed by the electrode itself.

Further, according to the electrostatic ultrasonic transducer according to the embodiment, since the rear-side fixed electrode is formed as a solid electrode, there is no need to align the through holes of the front-side fixed electrode with the through holes of the rear-side fixed electrode as is the case where the through holes are oppositely provided in the pair of fixed electrodes that sandwich the vibrating film. Assembly, therefore, becomes easier.

However, in the electrostatic ultrasonic transducer according to the third embodiment shown in FIG. 4, since the electrode configurations of the front-side fixed electrode and the rear-side fixed electrode are asymmetric, the electrostatic forces respectively acting thereon become asymmetric and distortion is produced in the output waveform. Assuming that the vibration of the vibrating film toward the front-side fixed electrode is a positive vibration, and the vibration toward the rear-side fixed electrode is negative vibration, when distortion, especially, a distortion component that is positively and negatively asymmetric (e.g., even harmonics distortion component) is produced in the waveform, in the case where an ultra-directional speaker is formed using the above transducer, the directionality of reproduced sound becomes deteriorated.

Not only in the electrostatic ultrasonic transducer shown in FIG. 4 but also in an electrostatic ultrasonic transducer according to other embodiments, there is a possibility that the vibrating film vibrates positively and negatively asymmetrically due to changes in mechanical characteristics and electrical characteristics because of aging.

An example of an electrical configuration of an electrostatic ultrasonic speaker according to the third embodiment of the invention will be described by referring to FIG. 6 to solve the above described problem. Here, an application example to the third embodiment will be described, but the electrical configuration shown in FIG. 6 can be also applied when an ultrasonic speaker is formed using the push-pull electrostatic ultrasonic transducer in the above described first or second embodiment.

Figure 6:
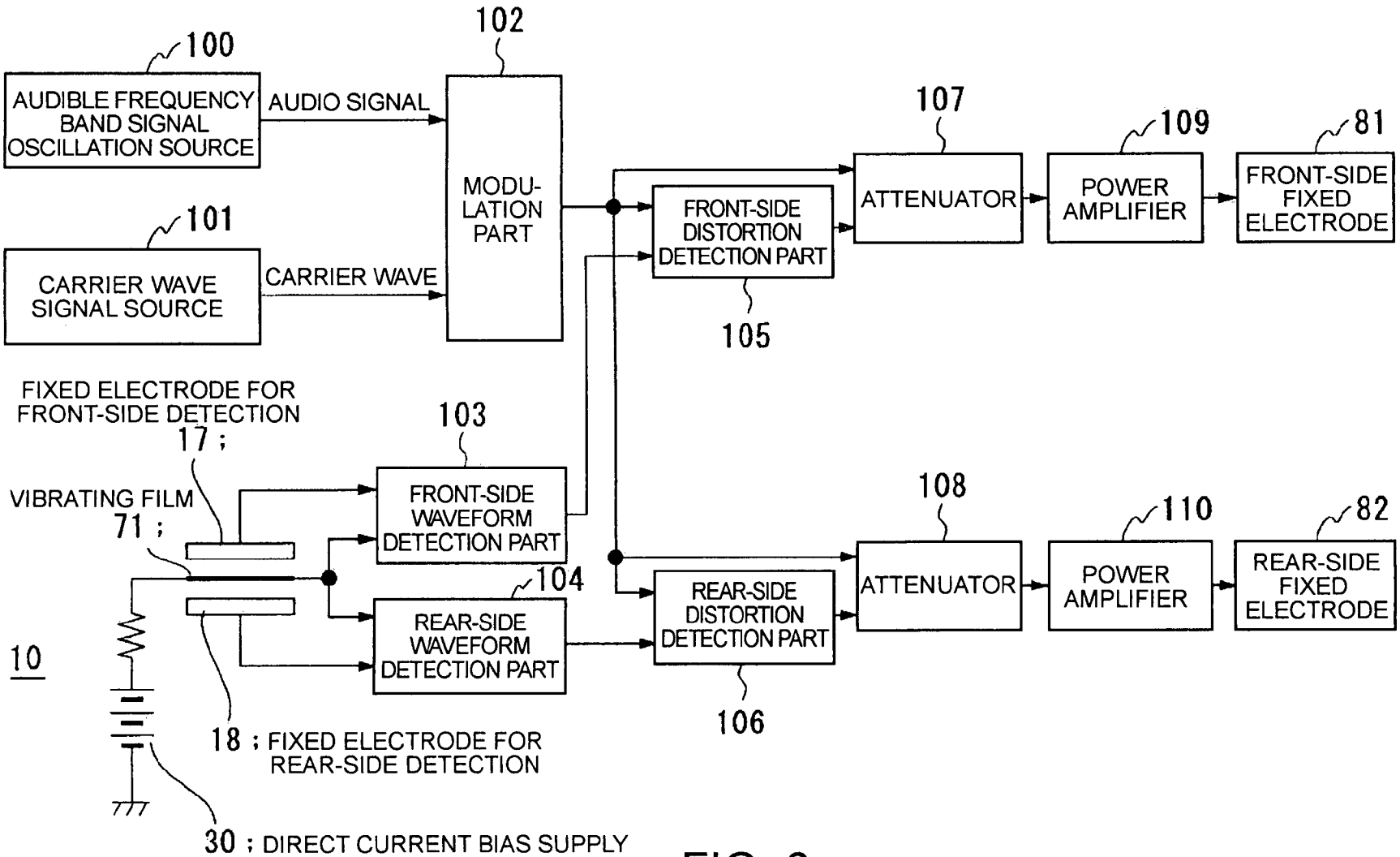
FIG. 6 is a block diagram showing an example of an electric configuration of an ultrasonic speaker according to the third embodiment of the invention.

In FIG. 6, the electrostatic ultrasonic speaker according to the third embodiment of the invention has an audible frequency band signal oscillation source 100 for generating a signal wave in an audible frequency band (e.g., audio signal), a carrier wave signal source 101 for generating carrier wave in an ultrasonic wave frequency band, a modulation part 102, a front-side waveform detection part 103, a rear-side waveform detection part 104, a front-side distortion detection part 105, a rear-side distortion detection part 106, attenuators 107, 108, power amplifiers 109, 110, and a push-pull type ultrasonic transducer 10 including a vibrating film 71, a front-side fixed electrode 81, and a rear-side fixed electrode 82.

A fixed electrode for front-side detection 17 for detecting the amplitude of the vibrating film 71 is provided in part of the front-side fixed electrode 81, and a fixed electrode for rear-side detection 18 for detecting the amplitude of the vibrating film 71 is provided in part of the rear-side fixed electrode 82, respectively.

The front-side waveform detection part 103 detects the gap between the vibrating film 71 and the fixed electrode for front-side detection 17, i.e., the amplitude of the vibrating film 71 from a position when a driving signal is not applied (neutral position) toward the front-side fixed electrode 81.

The rear-side waveform detection part 104 detects the gap between the vibrating film 71 and the fixed electrode for rear-side detection 18, i.e., the amplitude of the vibrating film 71 from a position when a driving signal is not applied (neutral position) toward the rear-side fixed electrode 82.

The front-side distortion detection part 105 compares a modulated signal as an original signal output from the modulation part 102 with amplification information (positive amplification information) of the output waveform of the vibrating film 71 output from the front-side waveform detection part 103, detects distortion of the amplitude of the output waveform of the vibrating film 71 toward the front-side fixed electrode 81 side, and outputs a control signal for adjusting an amount of attenuation of the attenuator 107 according to the amount of distortion so that the waveform distortion may be made smaller.

The rear-side distortion detection part 106 compares a modulated signal as a original signal output from the modulation part 102 with amplification information (negative amplification information) of the output waveform of the vibrating film 71 output from the rear-side waveform detection part 104, detects distortion of the amplitude of the output waveform of the vibrating film 71 toward the rear-side fixed electrode 82 side, and outputs a control signal for adjusting an amount of attenuation of the attenuator 108 according to the amount of distortion so that the waveform distortion may be made smaller.

Figure 8:
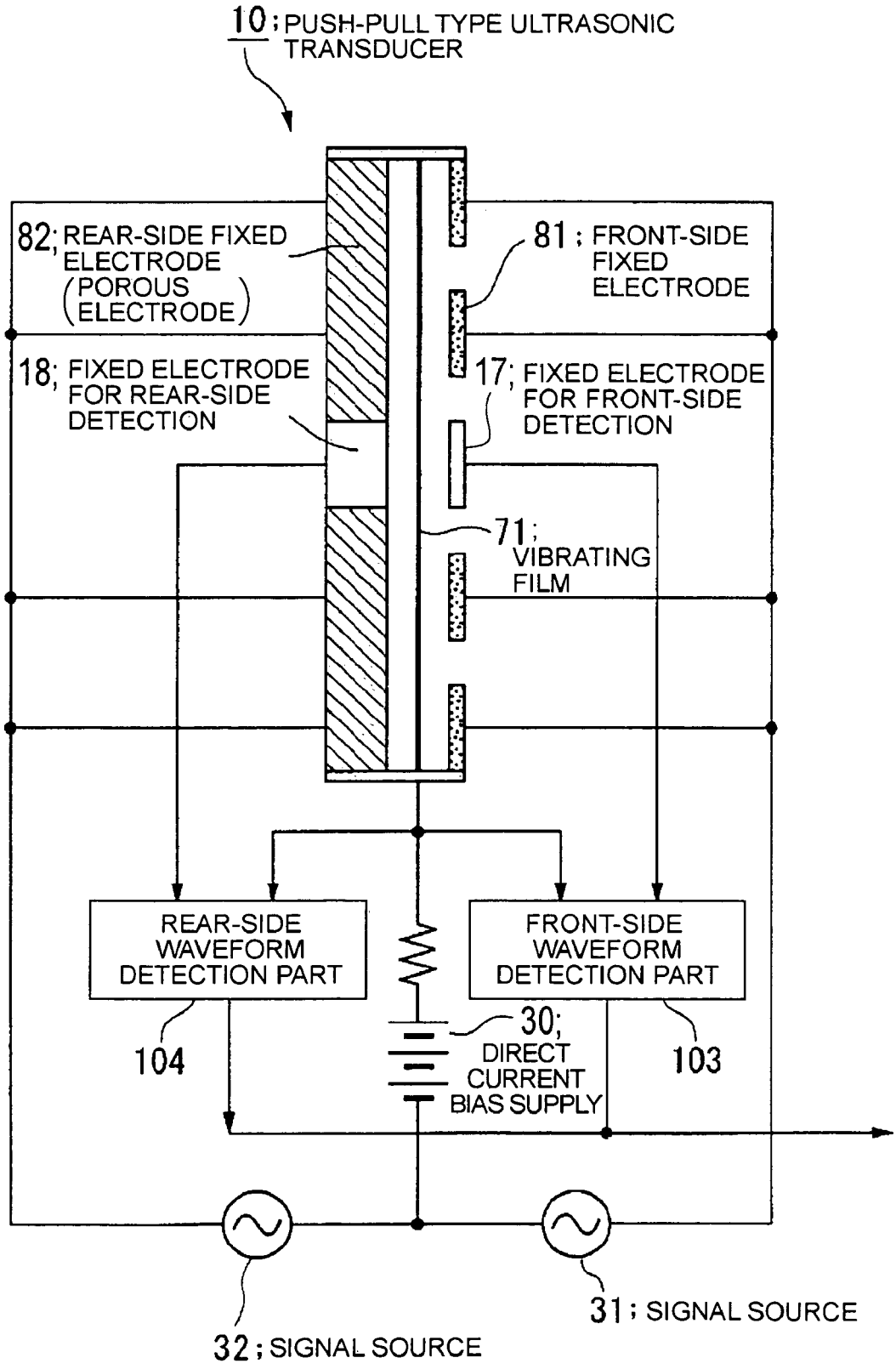
FIG. 8 shows a configuration example of a fixed electrode of the ultrasonic speaker according to the second or third embodiment of the invention.
Figure 9B:
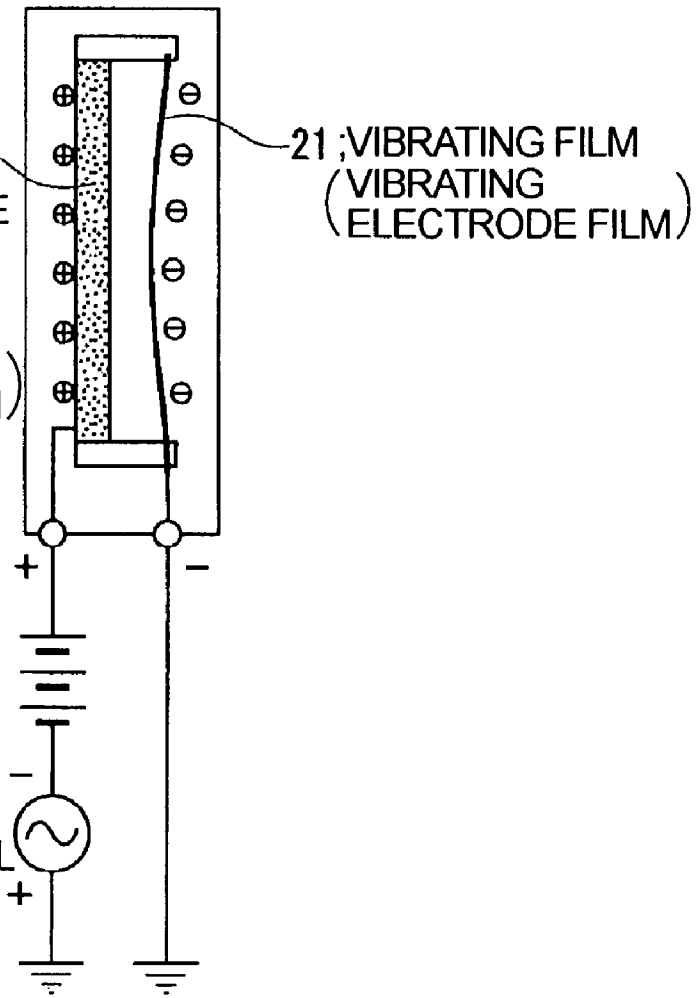
FIG. 9 is an explanatory diagram showing a driving concept of a pull-type electrostatic ultrasonic transducer.
Figure 9A:
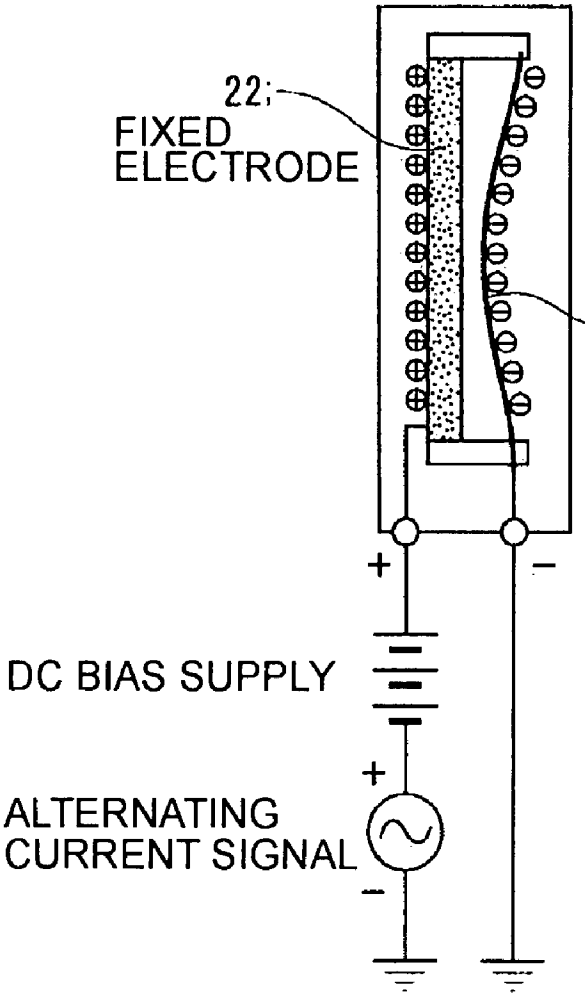
Figures 10A, 10B, 10C:
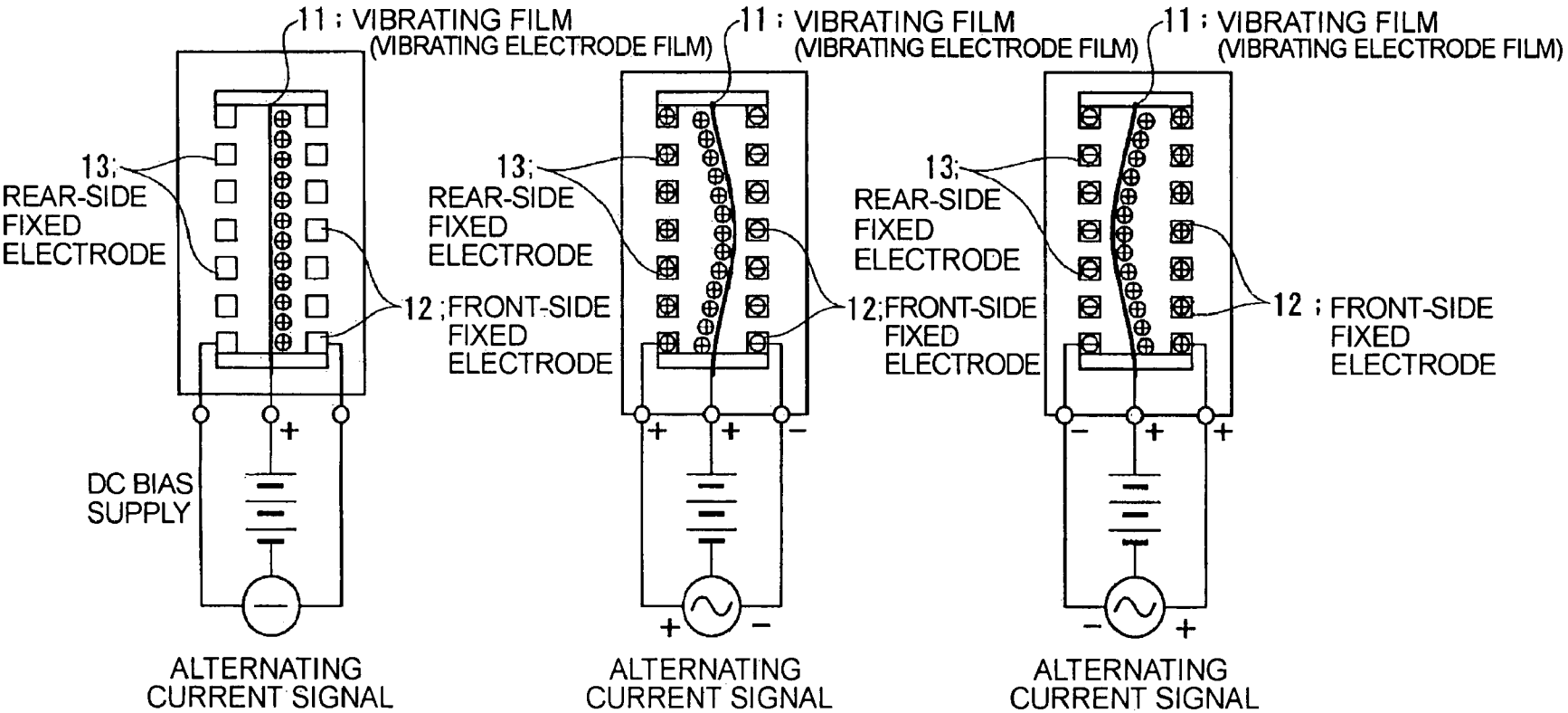
FIG. 10 is an explanatory diagram showing a driving concept of a push-pull type electrostatic ultrasonic transducer.

In the example shown in FIG. 6, a detection fixed electrode for waveform detection is required for the fixed electrode of the push-pull type ultrasonic transducer 10. In FIG. 8, an example of a fixed electrode provided with a detection electrode is shown.

In FIG. 8, parts of the opposed front-side fixed electrode 81 and rear-side fixed electrode 82 of the push-pull type ultrasonic transducer 10 are used as the fixed electrode for front-side detection 17 and the fixed electrode for rear-side detection 18, and output waveform information (amplitude information) toward the front side and rear side of the vibrating film 71 is detected.

The principle of output waveform detection is the same as the principle of capacitor microphone detection. Since capacitors are formed between the vibrating film 71 and the fixed electrode for front-side detection 17 and between the vibrating film 71 and the fixed electrode for rear-side detection 18, when the vibrating film 71 vibrates and the gap between the fixed electrode for front-side detection 17 and itself varies, the capacitance of the capacitor changes and the quantity of electric charge induced in the capacitor changes. As a result, the voltage between capacitor electrodes changes. Therefore, the gap between the fixed electrode for front-side detection 17 and the vibrating film 71, i.e., the amplitude (output waveform) of the vibrating film 71 can be detected by detecting the voltage between the vibrating film 71 and the fixed electrode for front-side detection 17. The principle is the same regarding the vibrating film 71 and the fixed electrode for rear-side detection 18.

In the example shown in FIG. 8, the example in which detection fixed electrodes 17 and 18 are provided on both front side and rear side of the push-pull type ultrasonic transducer 10 has been shown, however, the waveform distortion may be detected using only the fixed electrode for front-side detection 17, for example.

In the above configuration, a modulated signal (driving signal) output from the modulation part 102 is power-amplified to a predetermined level by the power amplifier 109 and applied between the front-side fixed electrode 81 and the vibrating film 71 that form the push-pull type ultrasonic transducer 10.

Similarly, a signal formed by phase-inverting the modulated signal (driving signal) output from the modulation part 102 is power-amplified to a predetermined level by the power amplifier 110 and applied between the rear-side fixed electrode 82 and the vibrating film 71. As a result, an electrostatic attraction force and an electrostatic repulsion force constantly act on the vibrating film 71 toward the same direction by these driving signals (alternating current signals), and the vibrating film 71 is push-pull driven at each time when the polarity of the driving signals is reversed because the directions in which the electrostatic attraction force and the electrostatic repulsion force act change. The sound wave generated by the vibrating film 71 is output from the sound wave output surface through the through holes provided in the front-side fixed electrode 81.

On the other hand, the gap between the vibrating film 71 and the fixed electrode for front-side detection 17, i.e., the amplitude of the vibrating film 71 from a position when a driving signal is not applied toward the front-side fixed electrode 81 (the amplitude in the positive direction) is detected by the front-side waveform detection part 103, and the gap between the vibrating film 71 and the fixed electrode for rear-side detection 18, i.e., the amplitude of the vibrating film 71 from a position when a driving signal is not applied toward the rear-side fixed electrode 82 (the amplitude in the negative direction) is detected by the rear-side waveform detection part 104.

The front-side distortion detection part 105 compares the modulated signal output from the modulation part 102 with amplification information (positive amplification information) of the output waveform of the vibrating film 71 output from the front-side waveform detection part 103, detects distortion of the amplitude of the output waveform of the vibrating film 71 toward the front-side fixed electrode 81 side, and outputs a control signal for adjusting an amount of attenuation of the attenuator 107 according to the amount of distortion so that the waveform distortion may be made smaller.

Further, the rear-side distortion detection part 106 compares the modulated signal output from the modulation part 102 with amplification information (negative amplification information) of the output waveform of the vibrating film 71 output from the rear-side waveform detection part 104, detects distortion of the amplitude of the output waveform of the vibrating film 71 toward the rear-side fixed electrode 82 side, and outputs a control signal for adjusting an amount of attenuation of the attenuator 108 according to the amount of distortion so that the waveform distortion may be made smaller.

As a result, the levels of the driving signals input to the power amplifiers 109 and 110 are adjusted according to the waveform distortion of the vibration waveform of the vibrating film 71 in the positive and negative directions, and the vibrating film 71 is controlled to vibrate positively and negatively symmetrically.

Figure 7:
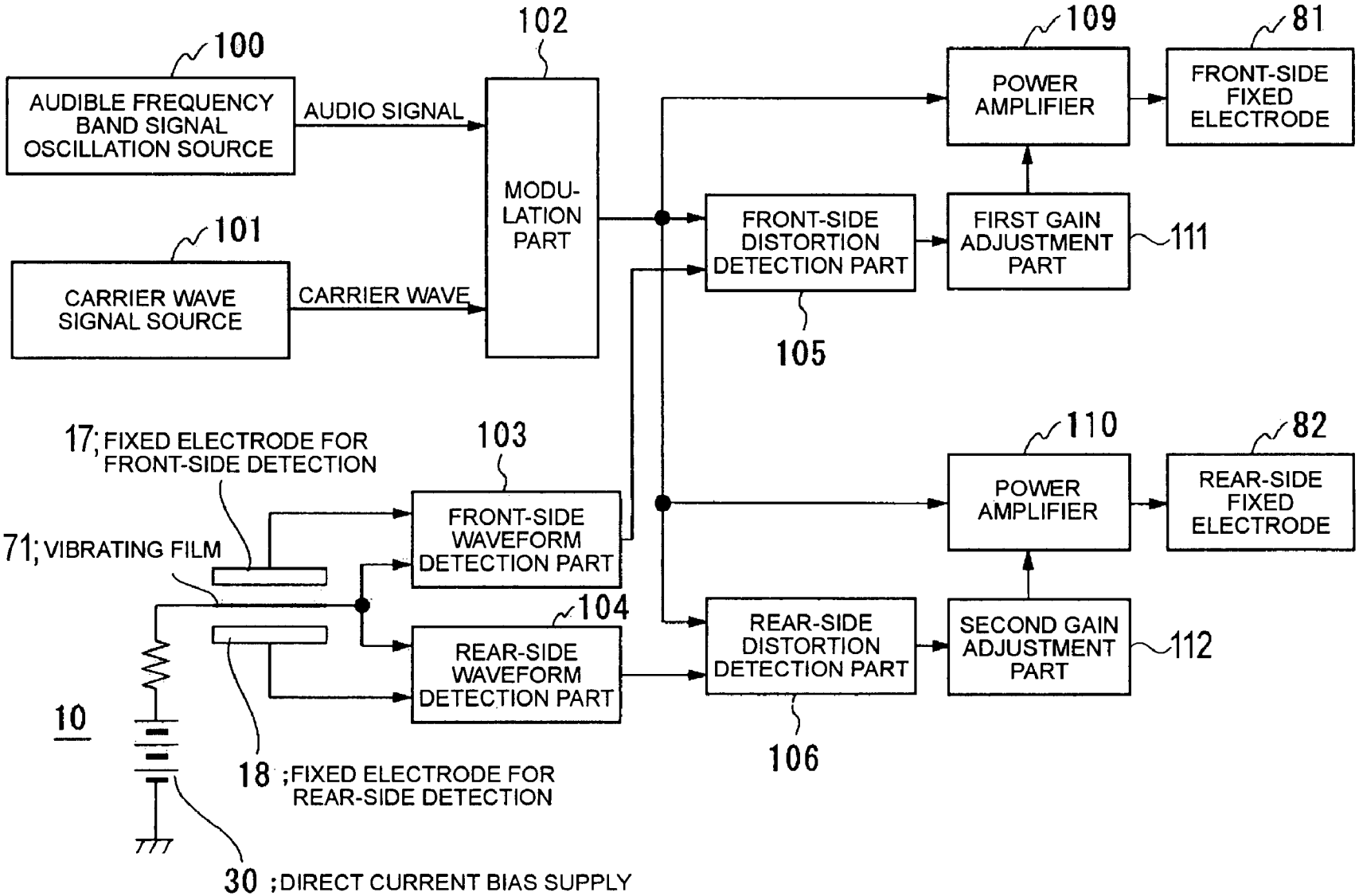
FIG. 7 is a block diagram showing another example of an electric configuration of an ultrasonic speaker according to the third embodiment of the invention.

Next, another electrical configuration of the ultrasonic speaker according to the third embodiment of the invention is shown in FIG. 7. The point at which the electrostatic ultrasonic speaker according to the third embodiment of the invention differs in configuration from the ultrasonic speaker shown in FIG. 6 is that the amplitude of vibration is adjusted by a first gain adjustment part 111 and a second gain adjustment part 112 which adjust each gain (amplification factor) of the power amplifiers according to the amount of distortion of the vibration waveform of the vibrating film instead of the attenuators which adjust the signal level input to the power amplifiers for supplying driving signals to the front-side fixed electrode and the rear-side fixed electrode. Since the other configuration is the same as that of the ultrasonic speaker shown in FIG. 6, any overlapping description will be omitted.

In FIG. 7, the ultrasonic speaker according to the third embodiment of the invention has an audible frequency band signal oscillation source 100 for generating a signal wave in an audible frequency band (e.g., an audio signal), a carrier wave signal source 101 for generating a carrier wave in an ultrasonic wave frequency band, a modulation part 102, a front-side waveform detection part 103, a rear-side waveform detection part 104, a front-side distortion detection part 105, a rear-side distortion detection part 106, power amplifiers 109 and 110, a first gain adjustment part 111 for adjusting gain of the power amplifier 109, a second gain adjustment part 112 for adjusting gain of the power amplifier 110, and a push-pull type ultrasonic transducer 10 including a vibrating film 71, a front-side fixed electrode 81, and a rear-side fixed electrode 82.

The front-side distortion detection part 105 compares a modulated signal as an original signal output from the modulation part 102 with amplification information (positive amplification information) of the output waveform of the vibrating film 71 output from the front-side waveform detection part 103, detects distortion of the amplitude of the output waveform of the vibrating film 71 toward the front-side fixed electrode 81 side, and outputs a control signal for adjusting the gain of the power amplifier 109 according to the amount of distortion so that the waveform distortion may be made smaller to the first gain adjustment part 111.

The rear-side distortion detection part 106 compares a modulated signal as an original signal output from the modulation part 102 with amplification information (negative amplification information) of the output waveform of the vibrating film 71 output from the rear-side waveform detection part 104, detects distortion of the amplitude of the output waveform of the vibrating film 71 toward the rear-side fixed electrode 82 side, and outputs a control signal for adjusting the gain of the power amplifier 110 according to the amount of distortion so that the waveform distortion may be made smaller to the second gain adjustment part 112.

Since the configuration of the fixed electrode provided with the detection electrode is the same as that in FIG. 8, the overlapping description will be omitted.

In the above configuration, modulated signals (driving signals) output from the modulation part 102 are power-amplified to a predetermined level by the power amplifiers 109 and 110 and applied between the front-side fixed electrode 81, the rear-side fixed electrode 82 and the vibrating film 71 that form the push-pull type ultrasonic transducer 10.

An electrostatic attraction force and an electrostatic repulsion force constantly act on the vibrating film 71 toward the same direction by these driving signals (alternating current signals), and the vibrating film 71 is push-pull driven at each time when the polarity of the driving signals is reversed because the directions in which the electrostatic attraction force and the electrostatic repulsion force act change.

On the other hand, the front-side distortion detection part 105 compares a modulated signal as an original signal output from the modulation part 102 with amplification information (positive amplification information) of the output waveform of the vibrating film 71 output from the front-side waveform detection part 103, detects distortion of the amplitude of the output waveform of the vibrating film 71 toward the front-side fixed electrode 81 side, and outputs a control signal for adjusting the gain of the power amplifier 109 according to the amount of distortion so that the waveform distortion may be made smaller to the first gain adjustment part 111.

Further, the rear-side distortion detection part 106 compares a modulated signal as an original signal output from the modulation part 102 with amplification information (negative amplification information) of the output waveform of the vibrating film 71 output from the rear-side waveform detection part 104, detects distortion of the amplitude of the output waveform of the vibrating film 71 toward the rear-side fixed electrode 82 side, and outputs a control signal for adjusting the gain of the power amplifier 110 according to the amount of distortion so that the waveform distortion may be made smaller to the second gain adjustment part 112.

As a result, the gain of the power amplifiers 109, 110 is adjusted according to the waveform distortion of the vibration waveform of the vibrating film 71 in the positive and negative directions, and the vibrating film 71 is controlled so as to vibrate positively and negatively symmetrically.

In the above described ultrasonic speaker according to the third embodiment of the invention, the amplitude of the vibrating film is detected by forming part of the fixed electrode as a detection electrode, and the gain of the power amplifier for the front-side fixed electrode (or the amount of attenuation of the input signal) and the gain of the power amplifier for the rear-side fixed electrode (or the amount of attenuation of the input signal) are controlled, respectively, so that the waveform distortion may be made smaller to the modulated waveform as an original signal based on the detected positive and negative (front side and rear side) amplitude information. Thereby, even in the case where the shape of the front-side fixed electrode (shapes of the through holes) and the shape of the rear-side fixed electrode (shapes of the through holes) are asymmetric, because the gain is automatically adjusted, the ultrasonic wave with low distortion can be output. Further, in the case where mechanical characteristics and electrical characteristics of the transducer vary because of aging or the like, the gain is automatically adjusted and the ultrasonic wave with low distortion can be output constantly. That is, the directionality of reproduced sound (self-demodulated sound) can be constantly maintained high.

In the electrical configuration of an electrostatic ultrasonic speaker according to the third embodiment of the invention, the gain of the power amplifier for the front-side fixed electrode (or the amount of attenuation of the input signal) and the gain of the power amplifier for the rear-side fixed electrode (or the amount of attenuation of the input signal) are automatically adjusted, respectively, so that the waveform distortion may be made smaller to the modulated waveform as an original signal. However, not limited to that, a power amplifier for amplifying the driving signal to be provided to the front-side fixed electrode and a power amplifier for amplifying the driving signal to be provided to the rear-side fixed electrode may be separately provided, and the amounts of attenuation of the input signals to the respective power amplifiers (or gain of the power amplifiers) may be separately adjusted manually by adjustment work at the time of factory shipment or a user, for example, so that the vibrating film may vibrate faithfully to the input signals (with small distortion).

As described above, in the electrostatic ultrasonic transducer and the ultrasonic speaker using the transducer of the invention, because the sound wave radiated toward the rear side of the push-pull ultrasonic transducer is absorbed by a sound absorbing material or a sound absorbing mechanism provided outside of the rear-side fixed electrode (at the rear side of the push-pull ultrasonic transducer), the sound wave is radiated only from the front side of the transducer.

Further, since the speaker has a configuration in which the electrostatic forces act on the vibrating film from both sides of the front side and the rear side, and the adverse effect on the film vibration due to reflection wave component of the sound wave radiated toward the rear side is reduced because of the sound absorbing mechanism, the distortion of the output waveform can be made smaller (faithful to the original sound), and the speaker can be formed as an ultrasonic speaker with high directionality.

Therefore, in the case where a speaker is integrally provided in equipment such as a projector and audition is performed with the sound wave reflected by the screen, the realistic sensation is not hindered and the sound quality deterioration due to the influence by the reflection sound wave within the equipment housing can be prevented.

Further, in the case where the speaker is configured as an ultra-directional speaker, also the directionality deterioration due to the influence by the reflection sound wave within the equipment housing can be prevented.

What is claimed is:

1. A push-pull type electrostatic ultrasonic transducer comprising:

a vibrating film having a conductive layer;

a sound insulating cover; and a pair of fixed electrodes including a front-side fixed electrode and a rear-side fixed electrode that sandwich respective surfaces of the vibrating film, a direct current bias voltage is applied to the conductive layer of the vibrating film by a direct current bias supply and an alternating current signal is applied to the fixed electrodes to allow the vibrating film to generate a sound wave and output the sound wave generated from the vibrating film from two sound wave output surfaces via a plurality of through holes provided in the respective pair of fixed electrodes, wherein the plurality of through holes provided in the front-side fixed electrode and the plurality of through holes provided in the rear-side fixed electrode have the same shapes and are provided in an opposed relationship;

wherein the sound insulating cover is provided facing the rear-side fixed electrode at a predetermined distance from a surface thereof; and wherein a distance L between the rear-side fixed electrode and the sound insulating cover is set based on $$L=(c/2\pi f)^2\cdot a/(t+\delta),$$

where f is an ultrasonic carry wave frequency at the time of rated driving, c is sound speed, a is an aperture ratio of a through portion of the rear-side fixed electrode, t is a thickness of the through portion of the rear-side fixed electrode, and δ is open-end correction constant depending on an aperture shape of the through portion.

2. The electrostatic ultrasonic transducer according to claim 1, further comprising:

driving means for adjusting a distance between the rear-side fixed electrode and the sound insulating cover; and control means for calculating a distance according to a frequency of a carry wave signal applied between the fixed electrodes and the vibrating film and controlling the driving means to provide the calculated distance.

3. The electrostatic ultrasonic transducer according to claim 1, wherein a sound absorbing material is provided between the rear-side fixed electrode and the sound insulating cover.

4. An ultrasonic speaker including the electrostatic ultrasonic transducer according to claim 2, the speaker being arranged to supply a modulated wave formed by modulating a carrier wave in an ultrasonic wave band with an acoustic signal in an audible band.

5. An ultrasonic speaker including the electrostatic ultrasonic transducer according to claim 3, the speaker being arranged to supply a modulated wave formed by modulating a carrier wave in an ultrasonic wave band with an acoustic signal in an audible band.

6. The ultrasonic speaker according to claim 4, further comprising gain adjustment means for separately adjusting a gain of a power amplifier for amplifying a driving signal to be supplied to the front-side fixed electrode of the electrostatic ultrasonic transducer and a gain of a power amplifier for amplifying a driving signal to be supplied to the rear-side fixed electrode of the electrostatic ultrasonic transducer.

7. The ultrasonic speaker according to claim 5, further comprising gain adjustment means for separately adjusting a gain of a power amplifier for amplifying a driving signal to be supplied to the front-side fixed electrode of the electrostatic ultrasonic transducer and a gain of a power amplifier for amplifying a driving signal to be supplied to the rear-side fixed electrode of the electrostatic ultrasonic transducer.

8. The ultrasonic speaker according to claim 4, further comprising:

a detection fixed electrode for detecting an amplitude of the vibrating film in part of the front-side fixed electrode and the rear-side fixed electrode of the push-pull type electrostatic ultrasonic transducer;

distortion detection means for detecting a vibrating distortion based on information of the amplitude of the vibrating film detected by the detection fixed electrode;

first gain adjustment means for adjusting a gain of a power amplifier for the front-side fixed electrode for amplifying a driving signal to be supplied to the front-side fixed electrode;

second gain adjustment means for adjusting a gain of a power amplifier for the rear-side fixed electrode for amplifying a driving signal to be supplied to the rear-side fixed electrode; and control means for controlling the first and second gain adjustment means based on the vibrating distortion information detected by the distortion detection means so that the vibrating distortion of the push-pull type electrostatic ultrasonic transducer may become smaller.

9. The ultrasonic speaker according to claim 5, further comprising:

a detection fixed electrode for detecting an amplitude of the vibrating film in part of the front-side fixed electrode and the rear-side fixed electrode of the push-pull type electrostatic ultrasonic transducer;

distortion detection means for detecting a vibrating distortion based on information of the amplitude of the vibrating film detected by the detection fixed electrode;

first gain adjustment means for adjusting a gain of a power amplifier for the front-side fixed electrode for amplifying a driving signal to be supplied to the front-side fixed electrode;

second gain adjustment means for adjusting a gain of a power amplifier for the rear-side fixed electrode for amplifying a driving signal to be supplied to the rear-side fixed electrode; and control means for controlling the first and second gain adjustment means based on the vibrating distortion information detected by the distortion detection means so that the vibrating distortion of the push-pull type electrostatic ultrasonic transducer may become smaller.

* * * * *